US006481535B1

(12) United States Patent
Fargo et al.

(10) Patent No.: US 6,481,535 B1
(45) Date of Patent: Nov. 19, 2002

(54) DISPATCHING ALGORITHM FOR PISTON-TYPE PASSENGER CONVEYING SYSTEM

(75) Inventors: Richard N. Fargo, Plainville, CT (US); Frank Sansevero, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/571,829

(22) Filed: May 16, 2000

(51) Int. Cl.[7] ..... B66B 1/18
(52) U.S. Cl. ..... 187/382; 187/389; 187/251
(58) Field of Search ..... 187/251, 249, 187/256, 258, 382, 383, 386, 388, 389, 392, 394; 254/294

(56) References Cited

U.S. PATENT DOCUMENTS

| | | | | |
|---|---|---|---|---|
| 2,771,160 A | | 11/1956 | Borden et al. | |
| 3,750,849 A | | 8/1973 | Berkovitz | |
| 4,846,311 A | * | 7/1989 | Thangavelu | 187/383 |
| 4,875,554 A | * | 10/1989 | MacDonald et al. | 187/382 |
| 5,083,640 A | * | 1/1992 | Tsuji | 187/382 |
| 5,460,245 A | * | 10/1995 | Bittar | 187/383 |
| 5,480,005 A | * | 1/1996 | Bittar | 187/383 |
| 5,663,538 A | * | 9/1997 | Sakita | 187/249 X |
| 5,758,748 A | * | 6/1998 | Barker et al. | 187/249 |

FOREIGN PATENT DOCUMENTS

| | | |
|---|---|---|
| EP | 0 781 724 A2 | 7/1997 |
| EP | 0 906 887 A1 | 4/1999 |

* cited by examiner

*Primary Examiner*—Joseph E. Valenza
*Assistant Examiner*—Thuy V. Tran

(57) ABSTRACT

An algorithm dispatches a series of cabs in a passenger conveying system of the type wherein there are at least four cabs moving between two floors. One cab is positioned at each floor at all times, and a cab is moving to each floor at all times. A control monitors the actual position of the cab, and compares the actual position to a desired position. If the desired and actual positions differ, then the control modifies a cycle time for at least some of the cabs to move the cabs closer to the desired position. In one embodiment, the four cabs are provided in two sets of paired cabs. The paired cabs move in direct opposition to each other. Preferably, the correction in the monitored/desired position of the cabs is made by changing the time period for which the doors are held open when the cabs are at a floor.

10 Claims, 3 Drawing Sheets

DISPATCHING ALGORITHM FOR PISTON-TYPE PASSENGER CONVEYING SYSTEM

BACKGROUND OF THE INVENTION

This invention relates to a dispatching algorithm for controlling the movement of passenger cabs in a piston-type passenger conveying system.

Typically, passengers are moved between the floors in low rise buildings such as malls, etc., by escalators. Escalators are widely utilized in most malls. Most malls also incorporate a few elevators for moving passengers between floors. Elevators do not move as many passengers as quickly as an escalator, due to wait time, door opening time, dwell time, etc. Moreover, shoppers in a mall seem to prefer the escalator in that they move more quickly between the floors and can look around the mall while moving.

Statistics show that the average escalator moves a much higher number of passengers than the average elevator in such locations. However, escalators have down sides. As an example, escalators do not transport strollers, wheelchairs, etc. as easily as elevators. Recently, the assignee of the present application developed a piston-type passenger conveying system. In the piston system, a set of at least three cabs are utilized to move the cabs between the two floors. A control moves the cabs such that a cab is waiting at each floor at all times. Another cab is moving between the floors. Contrary to typical elevator systems, the cabs are moved based upon a control algorithm to be in desired locations, rather than being moved in response to passenger requests.

The piston system provides the main benefits of both the escalator and the elevator. The basic movement technology is elevator technology. However, passenger flow is continuous, and thus a higher number of passengers can move between the floors. The basic invention as described above is disclosed in U.S. patent application Ser. No. 09/571,769, entitled "Piston-Type Passenger Conveying System", filed on even date herewith.

With such a system, real-world problems do arise. In one embodiment, a control for this system desirably dispatches four cabs between the floors such that each of the cabs are 90° out-of-phase with each other. However, at times, a passenger could hold a door open, or some other incident could cause at least one of the cabs to be out-of-phase relative to a desired position. In the preferred embodiment of the piston system, the cabs are grouped in pairs, which are each at directly opposed positions in the cycle. Thus, if one of the pair is held open, both of the cabs in a pair will be out-of-phase relative to the desired positions. The above application also discloses different numbers of cabs from three to six, or more. The out-of-phase relationship changes as the number of cabs change. However, with any number, the above problems of being out-of-phase from a desired position can exist.

A system would be desirable to account for and correct this out-of-phase positioning.

SUMMARY OF THE INVENTION

In a disclosed embodiment of this invention, a system identifies an out-of-phase cab, and determines a corrective action. Typically, the door hold-open time for a cab is modified such that the cabs quickly move back to being in phase. The door hold-open time is the easiest variable to control.

In other features of this invention, specific algorithms are disclosed to achieve the adjustment such as described above.

Further, a sleep mode is also disclosed for such a system. In the sleep mode, the piston system stops with at least one cab at each floor, until a passenger is sensed entering one of the cabs. When a passenger has entered the cab, the system moves back to its standard cycle. This is a separate and additional improvement over escalators. Escalators often have no sleep mode and will often use energy to run while empty for long periods of time. Some escalators do have a sleep mode, but most do not in the United States.

These and other features of the present invention can be best understood from the following specification and drawings, the following of which is a brief description.

DETAILED DESCRIPTION OF A PREFERRED EMBODIMENT

Figure 1:
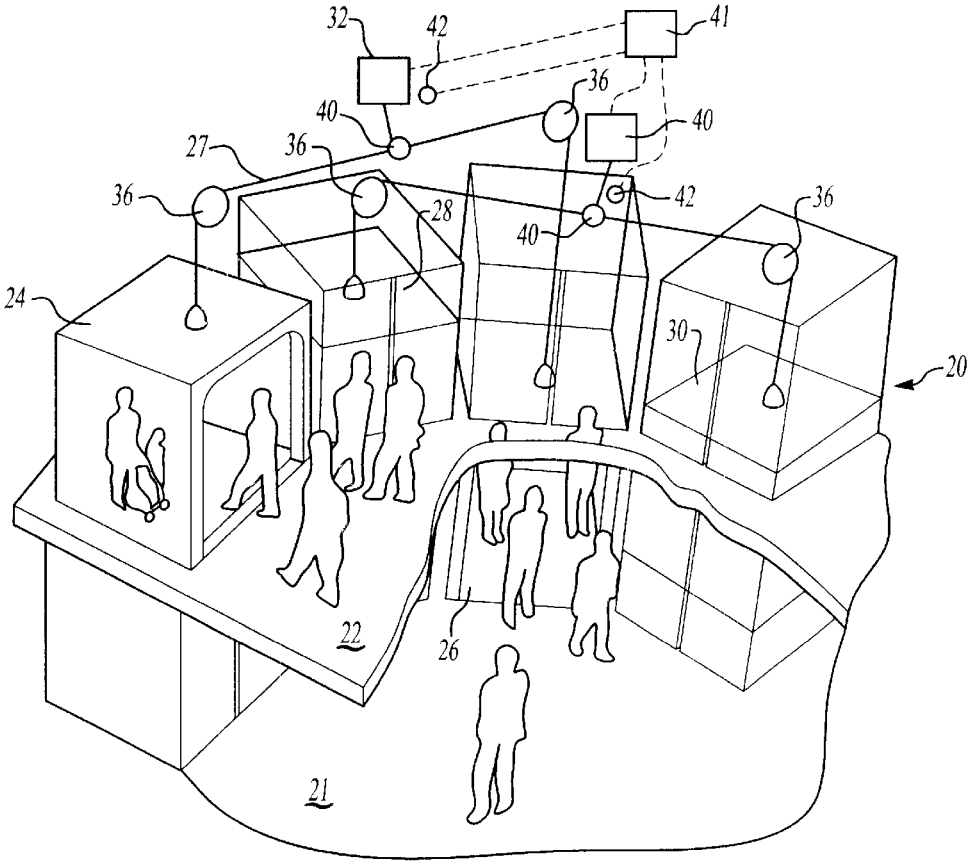
FIG. 1 is a schematic view of a piston-type system incorporating the present invention.

A piston system 20 is illustrated in FIG. 1 moving passengers between a first floor 21 and a second floor 22. The system is shown schematically in FIG. 1, and details and preferred aspects of this system are best understood from the co-pending patent application Ser. No. 09/571,769, entitled "Piston-Type Passenger Conveying System", filed on even date herewith.

As shown, a first cab 24 is paired with a second cab 26 by a cable or rope 27. Cab 24 is at the second floor 22 and cab 26 is at the first floor 21. A second cab pair includes a cab 28 and cab 30 connected by a rope 31. The cab 28 is moving to the second floor 22 and the cab 30 is moving to the first floor 21.

A machine 32, shown schematically, drives a sheave 40 to move the cable 27 around other sheaves 36 and drive the cabs 24 and 26 between the two floors. Similarly, a second machine 38 drives a power sheave 40 and moves the cable 31 around sheaves 36 to move the cabs 28 and 30. It should be understood that the machines 32 and 38 and the sheaves 40 and 36 are shown schematically.

A control 41 operates machines 32 and 38, and properly positions cabs 24, 28, 26 and 30 to achieve the goal of having a cab at each floor at all times. Sensors, or other feedback devices, are incorporated such that the exact position of the cabs is known. As shown schematically in these figures, sensors 42, could be associated with the drive sheaves 40. It should be understood that this is merely a schematic representation, and many ways of providing position feedback may be utilized.

Figure 2A:
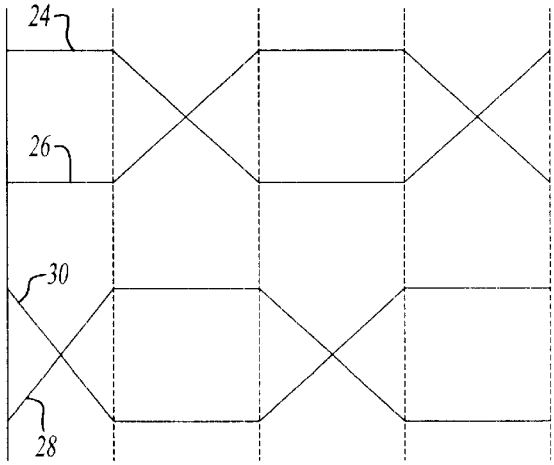
FIG. 2A shows an idealized movement graph for the four cabs illustrated in FIG. 1. This graph has applicability to other embodiments of the present invention.

FIG. 2A shows a timing chart for the movement of the several cabs. As shown, at a first time period, cab 24 is on the upper floor and cab 26 is on the lower floor. Cab 30 is heading downwardly and cab 28 is heading upwardly. This is the position such as illustrated in FIG. 1. As can be seen, at the end of the dwell period, cab 24, moves downwardly and cab 26 moves upwardly. The cab 28 has arrived at the upper floor before the cab 24 begins to move downwardly, and cab 30 arrives at the lower floor before the cab 26 begins to move upwardly. In this way, and as can be appreciated from the FIG. 2A graph, a cab will always be waiting at each floors, and another cab will always be on its way to each floor. In at least one embodiment in the above-referenced application, there are only three cabs. The cabs are maintained 120 degrees out of phase.

For the purposes of this application, the term "out of phase" refers to a cycle of movement of the cabs between the floors. As an example, a cycle of movement can be defined as the time a cab first arrives at one floor and until the time it again reaches that floor. The cabs are maintained out of phase within that cycle of movement relative to their respective positions. Further, for purposes of this application, the description of a cab being at each floor with a cab moving to each floor should be taken as reflective of the general movement and position. It may well be that a cab may arrive at a particular floor a short period of time before the cab at that floor leaves, or visa versa.

Moreover, within the control for the cabs, it is possible for the general cycle of movement to be overridden for certain periods of time. As an example, when a mall first opens, it may be desirable to have all of the cabs originally at the ground floor. However, in general, the above description of the movement of the several cabs provides a good understanding of the basic cycle of operation.

Figure 2B:
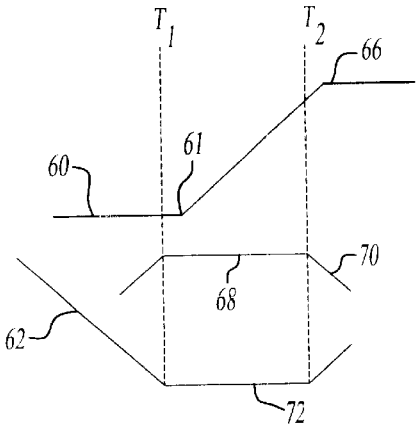
FIG. 2B shows a real-world problem in actually achieving the timing chart shown in FIG. 2A.

FIG. 2B shows a problem in actually achieving the timing chart shown in FIG. 2A.

As shown in FIG. 2B, a first cab 60 is waiting at the lower floor. A second cab 62 is moving downwardly. At time $T_1$, the cab 60 should begin moving upwardly. However, as shown, the cab 60 does not begin moving upwardly until a point 64, somewhat after the time $T_1$. This will happen if the door is held open such as by a passenger entering the cab as the doors begin to close. Once the cab 60 has been held open beyond the time period $T_1$, the cab 60 is no longer 90° out-of-phase from the cab 62. Instead, as can be seen, for a short period of time after time $T_1$, both cab 60 and cab 72 will be on the lower floor. Between time $T_1$ and $T_2$, the cab 68 is on the upper floor. After time 64, cab 60 begins moving to the upper floor. As can be appreciated, since the cab 60 did not leave the lower floor until after time $T_1$, it will not reach the upper floor until the point 66, after time $T_2$. However, the cab 68 has already begun to move downwardly at time $T_2$, such as shown at 70.

The above illustrates a problem in achieving the timing of FIG. 2A. There is no cab at the upper floor for a short period of time after time $T_2$. The same would be true at the lower floor if the cab 60 were paired for direct opposed movement with a second cab. The present invention is directed to identifying and correcting this movement away from the desired positions.

Figure 3:
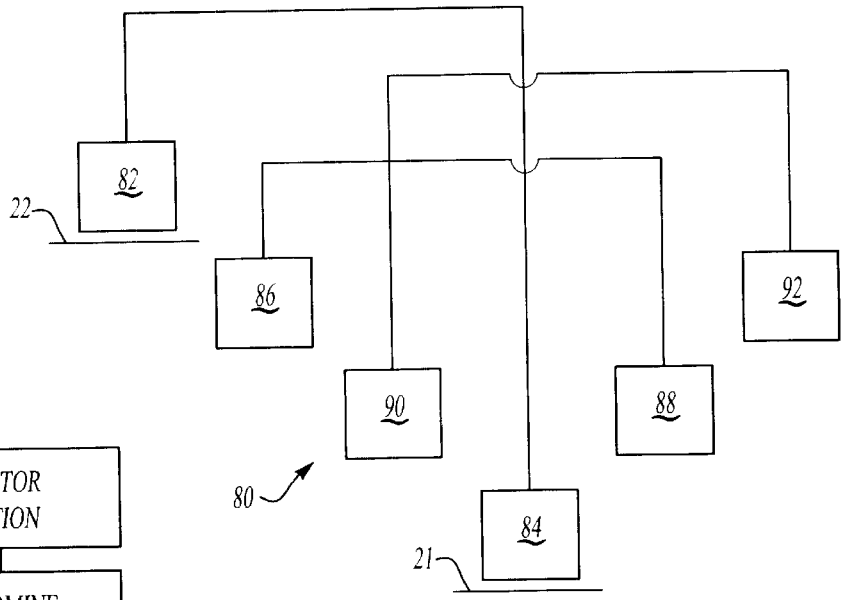
FIG. 3 shows another embodiment of the present invention.

FIG. 3 shows another embodiment 80 wherein there are three sets of cabs 82 and 84, 86 and 88, and 90 and 92. With such an arrangement, it becomes even more complex to achieve the proper phased movements. In this arrangement, the cabs 82 and 84 are shown at the floors, and the other cabs are moving to the floors. These cabs are each 60° out-of-phase as compared to the 90° out-of-phase movement of the FIG. 2A timing chart.

Figure 4:
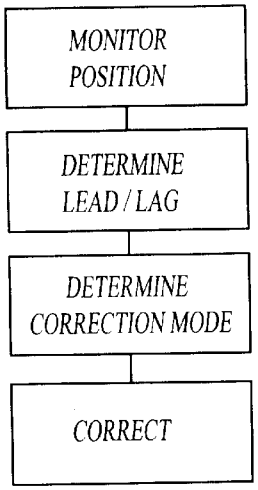
FIG. 4 is a flow chart of the above-referenced invention.

FIG. 4 is a flow chart for the present invention. As shown in FIG. 4, an ongoing step is to monitor the position of each of the cabs (through feedback sensors 42). Control 41 then determines whether there is a lead or lag in the desired phase spacing between the several cabs. If so, a correction mode is identified, and the timing is then corrected.

Essentially, the control adjusts the relative position of the cabs by changing the time of part of the cycle as illustrated in FIG. 2A. Typically, the easiest time to change would be the time wherein the cab is sitting at a floor. The door-open and door-close times are relatively difficult to change. However, the door is held open for a period of time. The door hold-open time is easy to change, and is typically of a long enough period of time such that it will allow quick adjustment of any out-of-phase positioning between the several cabs.

As an example, if the up flight time is seven seconds, the door opening time is two seconds, the nominal door hold-open time is eight seconds and the door closing time is three seconds, a normal cycle requires 20 seconds in each direction. The total cycle time is 40 seconds. Each of the four cabs in the FIG. 1 embodiment should lag by one-quarter of a cycle, or 10 seconds. Thus, a cab should be arriving and leaving each floor every 10 seconds. If one pair of elevator cabs lags by more than 10 seconds, the door-open hold time of the lagging cab can be decreased (i.e., to six seconds). At the same time, the door-open hold time of the leaving cab could be increased (i.e., to 10 seconds). With these times, the lag will be decreased by four seconds each half cycle, such that a system which is initially eight seconds out of the desired position will be re-synchronized in two half cycles or 40 seconds with no apparent disruption in passenger flow.

Since the cycle repeats, a lag of 20 seconds is identical to a lead of 20 seconds. If the lag is greater than 20 seconds (i.e., 22 seconds), it will be considered to be a lead of a smaller number (in this case, 18 second lead).

The algorithm can be extended to systems having three pairs, such as that shown in FIG. 3. However, it becomes more complex. One method would be to set one of the pair of cabs as a master, one as a forward set (which leads the master by 60°), and a third being a trailing set (which trail the masters by 60°). The door hold-open times of the forward and trailing sets are adjusted as before. As an example, the master is assumed to have no lag or lead time, but is utilized to synchronize the other two cab sets. If the forward cabs lead the master by more than 60°, the cabs' door open time may be increased. If the cabs lead by less than 60°, the cabs' door open time can be decreased. The trailing elevator could be handled in the same way. The times for the master need only be changed when the forward and trailing cabs are both lagging, or both are leading relative to the master. The same basic control can be used when only three cabs are used, as mentioned above.

An alternative method for re-synchronizing the cabs would be to stop a leading cab set until the lagging cab cab set catches up to the desired spacing. This method is less desirable than that mentioned above, as there is system down time, and this will reduce passenger flow.

Figure 5:
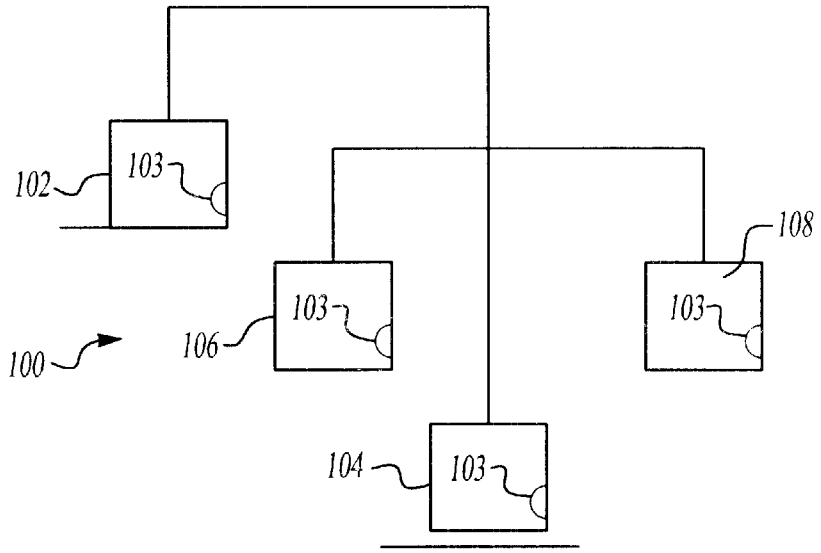
FIG. 5 shows yet another embodiment.

Another embodiment is illustrated in FIG. 5. In the FIG. 5 embodiment 100; a pair of cabs 102 and 104 are each provided with sensors 103. A second set of cabs 106 and 108 also have sensors 103. The sensors detect when a passenger enters the respective cabs. If a determination is made that all of the cabs are empty, then a cab set can stop in a sleep mode at each of the floors, such as illustrated in FIG. 5. Once a passenger enters the cab, as sensed by the sensor 103, then the normal run cycle is again started. Such sensors 103 could be light beam detectors in which a passenger would interrupt a beam of light. The sensors themselves are known. An alternative wake up device, such as a passenger actuated switch, could substitute for the sensors. In this way, the system is able to conserve energy in low passenger flow periods of time. In contrast, an escalator system typically runs continuously, and is not able to conserve energy in low passenger periods of time. In this embodiment, a door open button is preferably provided in each cab. In the event that a passenger does not leave the cab before the determination is made that there are no passengers in the cab the passenger can actuate the button. That is, if a determination is made that there are no passengers in a cab, and there is in fact a passenger left on the cab, it is preferable that a door open button be provided such that the passenger can leave the cab.

It should also be understood that there could be more than one sleep mode. That is during normal hours, a cab could be waiting at each floor while at other times the sleep mode could have the cabs all at one floor (i.e., first floor when a mall opens).

Figure 6:
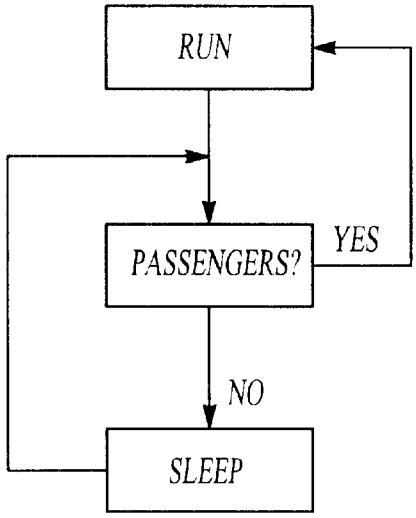
FIG. 6 is a flow chart of the FIG. 5 embodiment.

FIG. 6 shows a short flow chart for the FIG. 5 embodiment. As shown, the system will run the cabs 102, 104, 106 and 108 based upon a desired positioned algorithm. If a determination is made that a passenger is in the cab, the system continues to run. If a determination is made that there are no passengers in the cab, the system goes into a sleep mode. The system remains in sleep mode, periodically checking for passengers until a determination is made that a passenger has entered a cab. Once a passenger is in a cab, the cycle preferably repeats such as shown in FIG. 2A, with the proper spacing of the several cabs.

Although preferred embodiments of this invention have been disclosed, a worker in this art would recognize that certain modifications would come within the scope of this invention. For that reason, the following claims should be studied to determine the true scope and content of this invention.

We claim:

1. A method of operating a passenger movement system comprising:

providing at least three cabs that reciprocate between two floors and a control to dispatch the cabs to generally achieve at least one cab waiting on each of the two floors, such that each of said cabs are out-of-phase from the other cabs by a desired amount in a cycle of operation;

monitoring the position of each said cab and comparing said monitored position to a desired position;

identifying a lead or lag in each said monitored cab from said desired position; and changing a cycle time of movement of said cab to correct for said lead or lag.

2. A method as set forth in claim 1, wherein there are at least four of said cabs grouped into at least two pairs, said cabs of each of said pairs moving conversely relative to one another, and wherein, when a lead or lag is identified in either of said cabs in one of said pairs, said cycle time is changed for both of said cabs of the one of said pairs.

3. A method as set forth in claim 2, wherein there are three of said pairs of cabs, with each of said pairs of cabs being desirably spaced approximately 60° out-of-phase from each other.

4. A method as set forth in claim 3, wherein one of said pairs of cabs is defined as a master set, one of said pairs of cabs is defined as a leading set, and one of said pairs of cabs is defined as a trailing set, and when said leading set has a lead or lag from a desired position a cycle time of said leading set is changed, when said trailing set has a lead or lag from said desired position a cycle time of said trailing side is changed, said master set being utilized to set a desired position for each of said trailing and leading sets, said master set cycle time being changed when both said trailing and leading set deviate from said master set in the same direction.

5. A method as set forth in claim 1, wherein said system moves into a sleep mode when no passengers are identified in any of said cabs, said sleep mode including a cab remaining open at each of said two floors.

6. A method as set forth in claim 1, wherein cab doors for each of said cabs are held open for a period of time known as a cab door hold-open time, and said cab door hold-open time is changed to correct for said lead or lag.

7. A method as set forth in claim 1, wherein said cab doors are held open for a period of time at each of said floors known as a cab door hold open time, and said cab door hold open time is changed to correct for said lead or lag.

8. A method as set forth in claim 1, wherein there are three of said cabs, with each of said cabs being desirably spaced approximately 120° out-of-phase from each other, and wherein one of said cabs is defined as a master cab, one of said cabs is defined as a leading cab and one of said cabs is defined as a trailing cab, and when said leading cab has a lead or lag from a desired position, a cycle time of said leading cab is changed, when said trailing cab has a lead or lag from said desired position, a cycle time of said trailing cab is changed, said master cab being utilized to set a desired position for each of said training and leading cabs, said master cab cycle time being changed when both said leading and trailing cab deviate from said master cab in the same direction.

9. A method of operating a passenger conveying system comprising:

providing at least three cabs that reciprocate between two floors and a control to generally achieve a desired position for each of said cabs, said control moving said cabs to a desired position based upon a desired cycle, rather than in response to passenger call requests;

determining a lack of passengers in any of said cabs; and moving into a sleep mode with at least one cab waiting at each of said two floors if a determination is made that there are no passengers in any of said cabs.

10. A method as set forth in claim 9, wherein said system moves back to controlled movement of all of said cabs once a passenger enters any of said cabs.

* * * * *